US009738049B2

(12) United States Patent
Pipes et al.

(10) Patent No.: US 9,738,049 B2
(45) Date of Patent: Aug. 22, 2017

(54) BLANK CONFIGURED TO FORM A PACKAGE AND RELATED PACKAGE AND METHOD

(71) Applicant: R.J. REYNOLDS TOBACCO COMPANY, Winston-Salem, NC (US)

(72) Inventors: Jerry Wayne Pipes, Clemmons, NC (US); Wesley Steven Jones, Lexington, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 56 days.

(21) Appl. No.: 14/483,479

(22) Filed: Sep. 11, 2014

(65) Prior Publication Data

US 2016/0075467 A1 Mar. 17, 2016

(51) Int. Cl.

| | |
|---|---|
| ***B65D 5/49*** | (2006.01) |
| ***B65D 5/02*** | (2006.01) |
| ***B31B 1/26*** | (2006.01) |
| ***B65D 77/04*** | (2006.01) |

(52) U.S. Cl.

CPC ..... *B31B 1/26* (2013.01); *B65D 5/0227* (2013.01); *B65D 77/0413* (2013.01)

(58) Field of Classification Search

CPC .... B65D 5/48026; B65D 5/0227; B65D 5/06; B65D 5/48014; B65D 2571/0066; B65D 71/36; B65D 5/10; B31B 1/26; B31B 11/00

USPC ..... 229/120.37, 120.11, 120.18; 206/446, 206/418, 313, 463

See application file for complete search history.

(56) References Cited

U.S. PATENT DOCUMENTS

| | | | | |
|---|---|---|---|---|
| D47,574 | S | 7/1915 | Warren | |
| 1,932,804 | A | 10/1933 | Risk | |
| 2,128,197 | A | 8/1938 | Weil | |
| 3,059,830 | A | 10/1962 | Kramer | |
| 3,182,885 | A | 5/1965 | Maio | |
| 3,547,256 | A | 12/1970 | Bolding | |
| 3,695,422 | A | 10/1972 | Tripodi | |
| 3,874,581 | A | 4/1975 | Fox et al. | |
| 3,944,066 | A | 3/1976 | Niepmann | |
| 3,968,924 | A | 7/1976 | Tyrseck | |
| RE29,263 | E | 6/1977 | Roccaforte | |
| 4,181,220 | A | 1/1980 | Zicko | |
| 4,498,580 | A | 2/1985 | Getz et al. | |
| 4,717,017 | A | 1/1988 | Sprinkel, Jr. et al. | |
| 4,852,734 | A | 8/1989 | Allen et al. | |
| 4,903,844 | A * | 2/1990 | Oglesby | B65D 5/0227 156/289 |
| 5,000,374 | A | 3/1991 | Deiger | |
| D318,802 | S | 8/1991 | Egide | |
| 5,121,838 | A | 6/1992 | Dickie | |

(Continued)

*Primary Examiner* — Christopher Demeree
(74) *Attorney, Agent, or Firm* — Womble Carlyle Sandridge & Rice, LLP

(57) ABSTRACT

A blank configured to form a package is provided. The blank may include a bottom panel, a top panel, and an overlapping panel having an edge region and an adjoining region positioned between the edge region and the top panel. The adjoining region of the overlapping panel overlaps and attaches to the bottom panel to form a compartment when formed into a package. The compartment may be employed to store a consumable product, such as cartridges for an aerosol delivery device. A related method for forming the blank into the package is also provided.

16 Claims, 5 Drawing Sheets

(56) References Cited

U.S. PATENT DOCUMENTS

| | | | | |
|---|---|---|---|---|
| 5,333,729 | A | 8/1994 | Wolfe | |
| 5,542,539 | A | 8/1996 | Early | |
| D389,739 | S | 1/1998 | Auclair | |
| 5,871,145 | A | 2/1999 | Hermann et al. | |
| D427,522 | S | 7/2000 | Ponzio | |
| D432,418 | S | 10/2000 | Saulas | |
| D432,912 | S | 10/2000 | Lubineau-Bigot et al. | |
| D439,840 | S | 4/2001 | Saulas | |
| 7,028,839 | B2 | 4/2006 | Belloli et al. | |
| 7,367,455 | B2 | 5/2008 | Maffei | |
| 7,617,930 | B2 | 11/2009 | Jones et al. | |
| D643,747 | S | 8/2011 | Rye et al. | |
| 8,011,564 | B2 * | 9/2011 | Garner | B65D 71/36 229/110 |
| 524,218 | A1 | 6/2012 | Coatney | |
| 432,110 | A1 | 9/2012 | Potter | |
| 447,898 | A1 | 3/2013 | Burdock-Latter | |
| 448,549 | A1 | 3/2013 | Jones | |
| D686,065 | S | 7/2013 | Kuo et al. | |
| 2003/0217946 | A1 | 11/2003 | Hsu | |
| 2005/0150788 | A1 | 7/2005 | Feusner | |
| 2009/0266874 | A1 * | 10/2009 | Smith | B65D 71/36 229/109 |
| 2010/0065620 | A1 | 3/2010 | Smith | |

* cited by examiner

BLANK CONFIGURED TO FORM A PACKAGE AND RELATED PACKAGE AND METHOD

FIELD OF THE DISCLOSURE

The present disclosure relates to a blank configured to form a package, and more particularly to a blank configured to form a package and a related package and method. The package may be employed to hold one or more cartridges for an aerosol delivery device. The aerosol delivery device may be configured to heat an aerosol precursor in the cartridge, which may be made or derived from tobacco or otherwise incorporate tobacco, to form an inhalable substance for human consumption.

BACKGROUND

Popular smoking articles, such as cigarettes, conventionally have been sold in packages. Typically, each full package contains about 20 cigarettes. Cigarettes have been packaged in containers known as so-called "soft packs." See, for example, U.S. Pat. No. 3,695,422 to Tripodi; U.S. Pat. No. 4,717,017 to Sprinkel, Jr., et al.; and U.S. Pat. No. 5,333,729 to Wolfe, all of which are incorporated herein by reference. Cigarettes also have been packaged in containers known as so-called "hard packs" or "crush proof boxes." See, for example, U.S. Pat. No. 3,874,581 to Fox et al.; U.S. Pat. No. 3,944,066 to Niepmann; and U.S. Pat. No. 4,852,734 to Allen et al., all of which are incorporated herein by reference.

However, many smoking devices have been proposed through the years as improvements upon, or alternatives to, smoking products that require combusting tobacco for use. Many of those devices purportedly have been designed to provide the sensations associated with cigarette, cigar, or pipe smoking, but without delivering considerable quantities of incomplete combustion and pyrolysis products that result from the burning of tobacco. To this end, there have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al., U.S. Pat. App. Pub. No. 2013/0255702 to Griffith, Jr et al, U.S. Pat. App. Pub. No. 2014/0000638 to Sebastian et al, U.S. Pat. App. Pub. No, 2014/0060554 to Collett et al, and U.S. Pat. App. Pub. No. 2014/0096781 to Sears et al, which are incorporated herein by reference.

Some embodiments of aerosol cartridges may employ cartridges to store an aerosol precursor useable in conjunction with a control body of an aerosol delivery device to form aerosol and simulate smoking, as described above. The cartridges or other containers useable in conjunction with an aerosol delivery device may differ in size or shape from traditional smoking articles. Accordingly, it would be desirable to provide a blank, package and related method for packaging one or more cartridges for an aerosol delivery device or other product.

SUMMARY OF THE DISCLOSURE

In one aspect a blank configured to form a package is provided. The blank may comprise a bottom panel, a top panel coupled to the bottom panel, and an overlapping panel coupled to the top panel. The overlapping panel may include an edge region and an adjoining region. The overlapping panel may be configured to overlap with the bottom panel and attach to the bottom panel at the adjoining region when forming the package.

In some embodiments the blank may further comprise a first connecting panel positioned between the bottom panel and the top panel, and a second connecting panel positioned between the top panel and the overlapping panel. The blank may further comprise a first plurality of end panels coupled to the bottom panel and a second plurality of end panels coupled to the top panel, wherein the first plurality of end panels are configured to overlap with the second plurality of end panels. The second plurality of end panels may be longer in a longitudinal direction than the first plurality of end panels. The edge region may be configured to remain unattached to the bottom panel when forming the package.

In an additional aspect a package is provided. The package may comprise a bottom panel, a top panel coupled to the bottom panel, an overlapping panel coupled to the top panel, a first connecting panel positioned between the bottom panel and the top panel, and a second connecting panel positioned between the top panel and the overlapping panel. The overlapping panel may further comprise an edge region and an adjoining region. The adjoining region may be positioned between the edge region and the top panel. The overlapping panel may be overlapping at least a portion of the bottom panel to form a compartment such that the adjoining region is attached to the bottom panel, and the edge region is unattached to the bottom panel.

In some embodiments the package may be configured so that the compartment provides a substantially uniform rectangular cross section along a lateral direction. The bottom panel may not be completely overlapped by the overlapping panel. In some cases, approximately half of the bottom panel is overlapped by the overlapping panel.

In some embodiments the package may additionally include a first plurality of end panels coupled to the bottom panel and a second plurality of end panels coupled to the top panel, wherein the first plurality of end panels overlap with the second plurality of end panels. The second plurality of end panels may be longer in a longitudinal direction than the first plurality of end panels. The package may have the edge region and the adjoining region approximately bisect the overlapping panel. The package may also include a container positioned within the package's cavity. The container may have a flange disposed between the bottom panel and the edge region of the overlapping panel.

In a further aspect a method for forming a package is provided. The method can include providing a blank defining a first side and a second side. The blank may comprise a bottom panel, a top panel coupled to the bottom panel, and an overlapping panel coupled to the top panel. The overlapping panel may have an edge region and an adjoining region. The adjoining region can be positioned between the edge region and the top panel. The method may also include folding the blank between the overlapping panel and the top panel toward the second side and folding the blank between the top panel and the bottom panel toward the second side. The method may also include attaching the adjoining region of the overlapping panel to the bottom panel.

In some embodiments, folding the blank avoids folding each of the top panel, the bottom panel and the overlapping panel with respect to itself. In some embodiments the blank may also include a first plurality of end panels coupled to the bottom panel and a second plurality of end panels coupled to the top panel. The method may further include folding the first plurality of end panels relative to the bottom panel toward the second side, folding the second plurality of end panels relative to the top panel toward the second side, and coupling the first plurality of end panels to the second plurality of end panels.

Other aspects and advantages of the present disclosure are apparent from the following.

BRIEF DESCRIPTION OF THE DRAWINGS

In order to assist the understanding of embodiments of the disclosure, reference will now be made to the appended drawings, which are not necessarily drawn to scale. The drawings are exemplary only, and should not be construed as limiting the disclosure.

DETAILED DESCRIPTION OF THE PREFERRED EMBODIMENTS

The present disclosure now will be described more fully hereinafter with reference to the accompanying drawings. The disclosure may be embodied in many different forms and should not be construed as limited to the embodiments set forth herein; rather, these embodiments are provided so that this disclosure will satisfy applicable legal requirements. Like numbers refer to like elements throughout. As used in this specification and the claims, the singular forms "a," "an," and "the" include plural references unless the context clearly dictates otherwise.

As described herein, embodiments of the disclosure relate to blanks configured to form a package and related packages and methods. Related embodiments have been previously described in U.S. patent application Ser. No. 13/798,779, filed Mar. 13, 2013, the disclosure of which is incorporated herein by reference.

Figure 1:
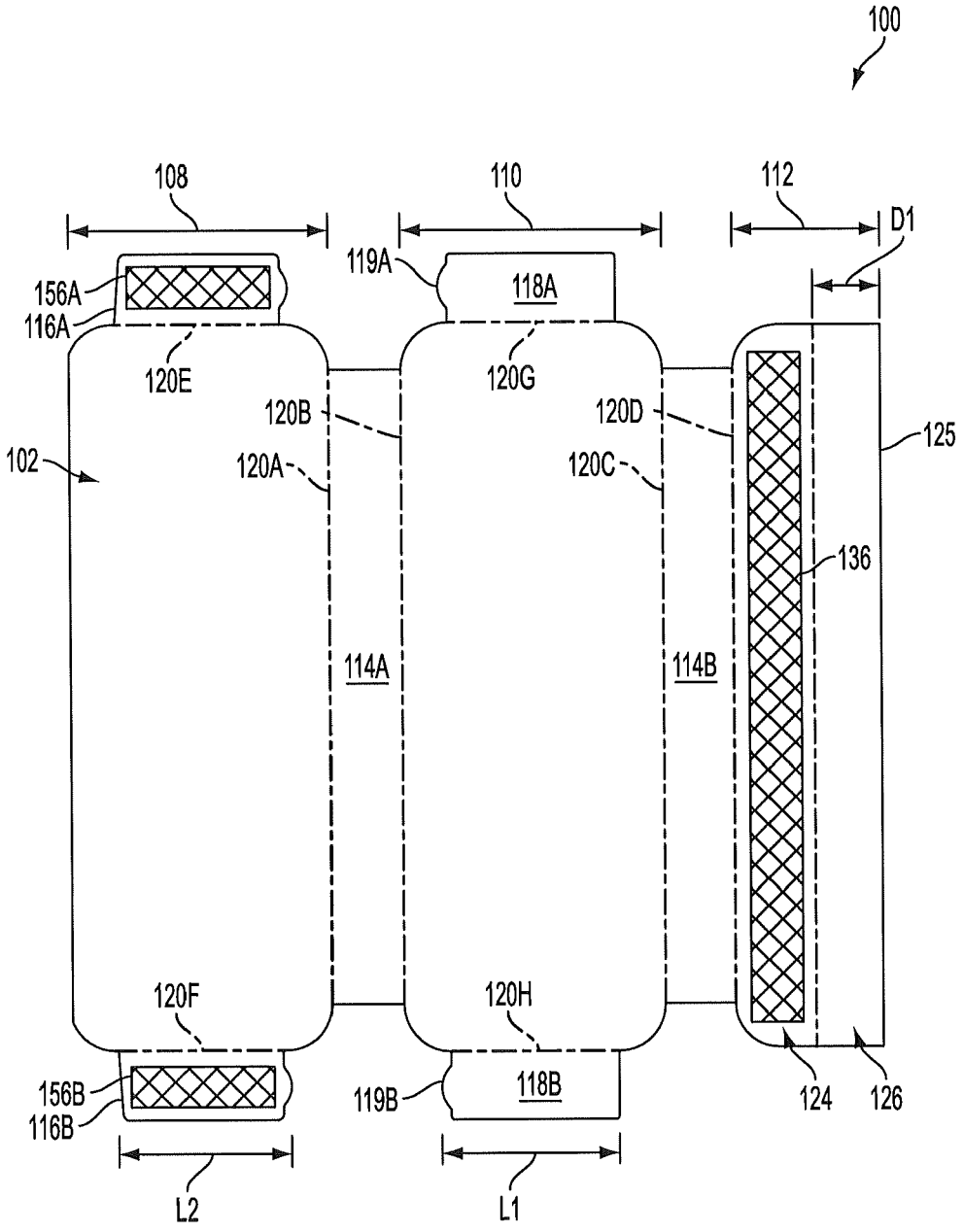
FIG. 1 is a plan view of a first side of a blank configured to form a package according to an example embodiment of the present disclosure.
Figure 2:
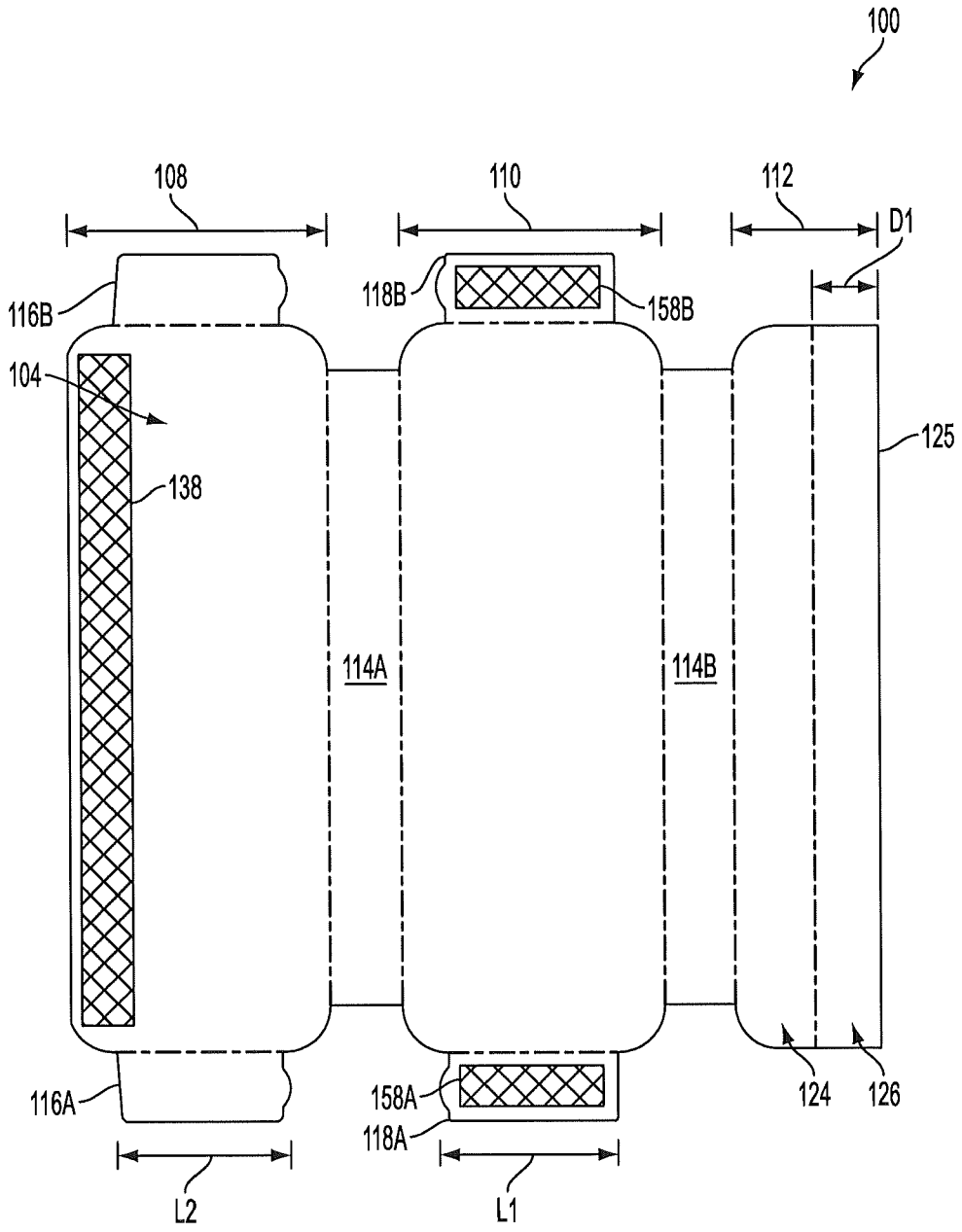
FIG. 2 is a plan view of a second opposing side of the blank of FIG. 1.

FIG. 1 illustrates a plan view of a first side 102 of an example embodiment of a blank 100 configured to form a package. FIG. 2 illustrates a plan view of an opposing second side 104 of the blank. The blank 100 may be understood as a substantially two-dimensional structure configured to be manipulated into a three-dimensional package.

The blank 100 may comprise one or more layers of one or more materials suitable to provide structure to the blank such that it may form a package as described below. For example, the blank 100 may comprise paper, paperboard, cardboard, thermoplastic, or any other suitable material. In some embodiments the material defining the blank 100 may be laminated or coated with wax or other material. Further, the blank 100 may be imprinted via any of various known methods to provide the blank with, for example, an ornamental design, and/or identifying information. Useful exemplary materials include paperboard of a suitable type and stock, such as 10 to 14 point SBS paper board (i.e., solid bleached sulfate paper), which may include a coating on one or both sides, such as a clay coating. Comparable board containing post-consumer recycled content likewise may be used. Suitable paper stock can be obtained commercially, such as from International Paper or MeadWestvaco.

The blank 100 may define various embodiments of sizes and shapes. Accordingly, it should be understood that the embodiment of the illustrated blank 100 is provided for example purposes only. In this regard, as illustrated, the blank 100 may comprise a bottom panel 108, a top panel 110, and an overlapping panel 112. The top panel 110 may be coupled to the bottom panel 108, and the overlapping panel 112 may be coupled to the top panel 110 in relative sequential order.

In the illustrated example, the blank 100 may further comprise a first connecting panel 114A, and a second connecting panel 114B (collectively, "connecting panels 114"). The first connecting panel 114A may be positioned between the bottom panel 108 and the top panel 110, and the second connecting panel 114B may be positioned between the top panel 110 and the overlapping panel 112. In some embodiments the connecting panels 114 may be significantly smaller than the bottom panel 108 and the top panel 110 to account for the smallest dimension of the completed package.

The blank 100 defines a longitudinal direction traversing from the bottom panel 108 to the overlapping panel 112 via the top panel 110 and the connecting panels 114. A lateral direction of the blank 100, or portions thereof, is a direction perpendicular to the longitudinal direction in the plane of the blank 100.

Further, the blank 100 may comprise a first plurality of end panels 116A, B (collectively, "first end panels 116") coupled to the bottom panel 108 at respective lateral ends thereof. Similarly, the top panel 110 may include a second plurality of end panels 118A, B (collectively, "second end panels 118") coupled at respective lateral ends thereof. As described below, the first end panels 116 may be configured to overlap with the second end panels 118 when the blank 100 is formed into a package.

In some embodiments, as illustrated, the second end panels 118 may define a first longitudinal length L1 greater than a second longitudinal length L2 defined by the first end panels 116. In this regard, the second end panels 118 are illustrated as respectively including an extension 119A, B that is configured to extend past the end of the first end panels 116 when the first end panels and the second end panels overlap. Accordingly, the extensions 119A, B may be grasped by a user and employed to release a coupling between the first end panels 116 and the second end panels 118 to open the package formed from the blank 100.

In the illustrated embodiment, the first end panels 116 have a substantially similar shape to the second end panels 118 while the first end panels are slightly smaller. In alternative embodiments, the first end panels 116 and the second end panels 118 may differ in shape. In other embodiments, the first end panels 116 and the second end panels 118 may have the same or approximately the same size.

In the illustrated embodiment, the first longitudinal length L1 may be shorter than a longitudinal length of the top panel 110 to which the second end panels 118 are attached. In this example, the resulting package may include openings around the periphery thereof that allow for at least partially viewing the interior of the package.

The boundaries between the panels may be defined by a plurality of predetermined fold lines 120A-H (collectively "fold lines 120.") Some or all of the fold lines 120 may be imaginary lines shown in FIGS. 1 and 2 for illustration purposes only. Some or all of the fold lines 120 may be formed in the blank 100 by stamping, indenting or pre-creasing the corresponding sections of the blank. Further still, some or all of the fold lines 120 may be provided with a series of perforations to assist with folding of the blank along the predetermined fold lines.

As seen in FIG. 1, a first fold line 120A extends between the bottom panel 108 and the first connecting panel 114A. A second fold line 120B extends between the first connecting panel 114A and the top panel 110. A third fold line 120C extends between the top panel 110 and the second connecting panel 114B. A forth fold line 120D extends between the second connecting panel 114B and the overlapping panel 112. Fifth and sixth fold lines 120E, F extend between the bottom panel 108 and respective first end panels 116A, B. Seventh and eighth fold lines 120G, H extend between the top panel 110 and respective second end panels 118A, B.

Having described in the individual panels 108, 110, 112, 114, 116, 118 of the blank 100 in the illustrated embodiment, it should be appreciated that additional panels may be added to the blank without deviating from the scope of this disclosure. However, it should also be appreciated that in some embodiments, advantages may stem from the blank 100 exclusively defined by surface defined by the set of illustrated panels without more.

The overlapping panel 112 may comprise an adjoining region 124 and an edge region 126. The adjoining region 124 is positioned between the edge region 126 and the top panel 110 and/or the second connecting panel 114B. Therefore the adjoining region 124 adjoins the edge region 126 to the remainder of the blank 100. As discussed below, the adjoining region 124 may be configured to attach to the bottom panel 108 in the assembled package formed from the blank.

The edge region 126 may extend a first distance D1 from a distal end 125 along the longitudinal direction. In the illustrated embodiment, the edge region 126 and the adjoining region 124 approximately bisect the overlapping panel 112, though the relative size of the edge region 126 may be larger or smaller depending upon several factors, such as the material used for the blank, or the product being packaged. The edge region 126 and the adjoining region 124 would approximately bisect the overlapping panel if the edge region extended between 25% and 75% of the longitudinal length of the overlapping panel 112.

Figure 3:
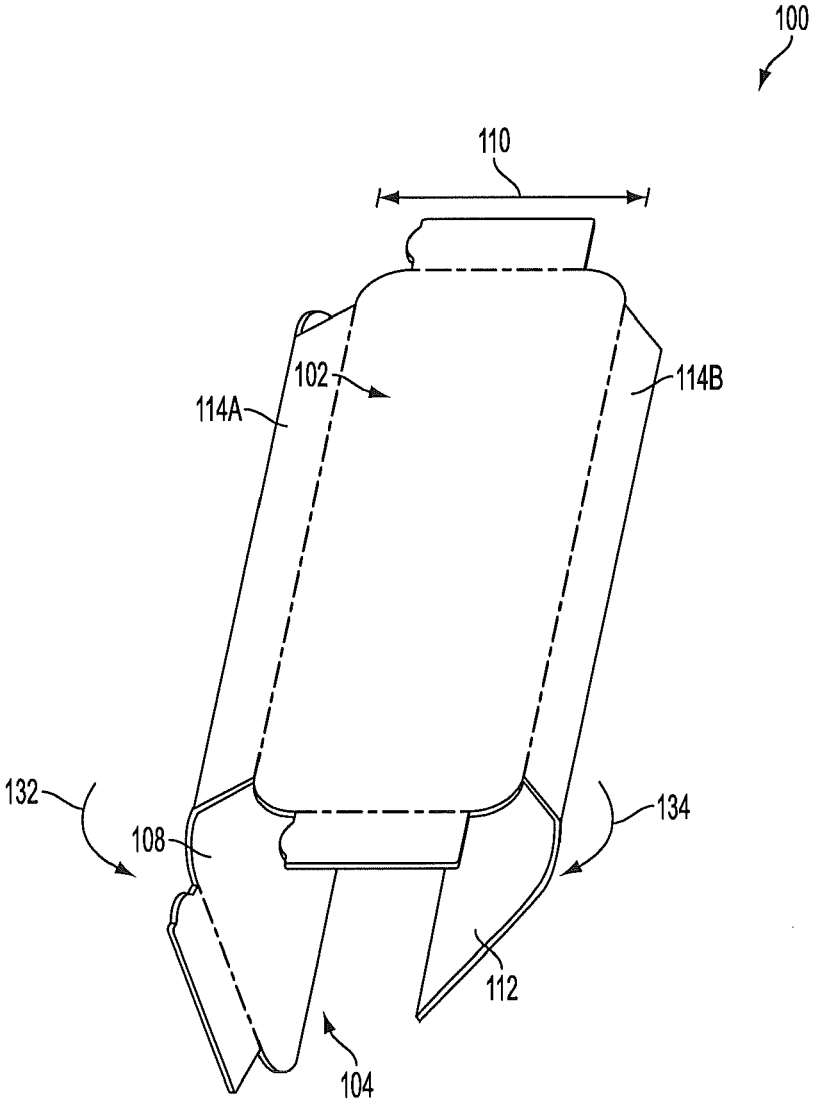
FIG. 3 is a perspective view of steps employed to form the blank of FIG. 1 into a package.

As mentioned above, the blank 100 may be formed into a package. In this regard, FIG. 3 illustrates operations performed in forming the blank 100 into a package from the initial flat configuration illustrated in FIG. 1. The blank 100 may be folded between the bottom panel 108 and the top panel 110. More particularly, the blank may be folded between the bottom panel 108 and the first connecting panel 114A at the first fold line 120A and folded between the first connecting panel 114A and the top panel 110 at the second fold line 120B. The bottom panel 108 may be folded toward the second side 104 of the blank 100 is a substantially counterclockwise direction, in terms of the orientation illustrated in FIG. 3, as indicated by arrow 132.

The blank 100 may also be folded between the overlapping panel 112 and the top panel 110. More particularly, the blank 100 may be folded between the overlapping panel 112 and the second connecting panel 114B at the fourth fold line 120D and folded between the second connecting panel 114B and the top panel 110 at the third fold line 120C. The overlapping panel 112 may be folded toward the second side 104 of the blank 100 in a substantially clockwise direction, in terms of the orientation illustrated in FIG. 3, as indicated by arrow 134.

The first side 102 of the overlapping panel 112 may be attached to the second side 104 of the bottom panel 108 during the folding movement illustrated in FIG. 3 via an adhesive or other bonding mechanism such as via a heat weld. Exemplary types of adhesives that may be used include vinyl acetates, hot melts, and dextrins, including adhesives such as those available from Henkel AG & Co. As illustrated in FIG. 1, an adhesive may be placed on the first side 102 of the overlapping panel 112 at an adhesive area 136 corresponding with at least a portion of the adjoining region 124 and/or, as seen in FIG. 2, at an adhesive area 138 on the second side of the bottom panel 108. As illustrated, the one or more adhesive areas 136, 138 may be sized and shaped such that only the adjoining region 124 of the overlapping panel 112, as opposed to the surrounding portions of the blank 100, is coupled to the bottom panel 108 during the folding movement illustrated in FIG. 3. In other words, in the illustrated embodiment, the edge region 126 remains unattached to the bottom panel 108.

Figure 4:
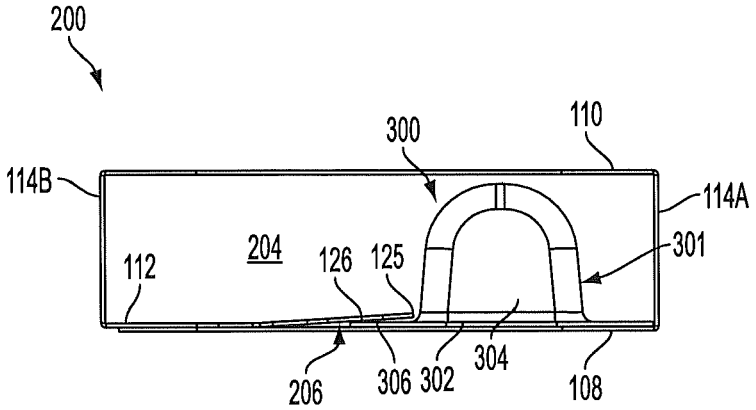
FIG. 4 is a left side view of a package formed from the blank of FIG. 1 and including a product received therein and end panels open according to an example embodiment of the present disclosure.
Figure 5:
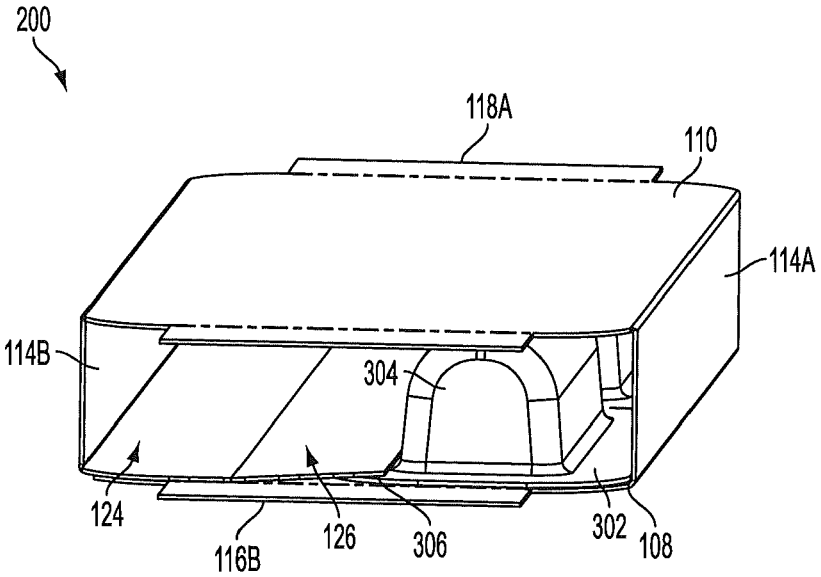
FIG. 5 is a perspective view of the package of FIG. 4.

Accordingly, as illustrated in FIGS. 4 and 5, a package 200 may be formed by the above-described operations. FIG. 4 illustrates a left side view of the package 200. FIG. 5 illustrates a perspective view of the package 200. The package 200 may initially define a substantially flat configuration when produced by the above-described folding operations. When expanded, as illustrated, the package 200 may define a compartment 204. The compartment 204 has a substantially uniform rectangular cross section along the lateral direction defined by the blank. The compartment 204 may be defined by the bottom panel 108, the top panel 110, and the end panels 116, 118. The edge region 126 of the overlapping panel 112 forms a flap overlaying the second side 104 of the bottom panel 108. A pocket 206 may be partially defined between the edge region 126 and the bottom panel 108. The bottom panel 108 is not completely overlapped by the overlapping panel 112. In other words, the distal end 125 does not extend to the first connecting panel 114A when the package 200 is formed. As illustrated, approximately half of the bottom panel 108 is overlapped by the overlapping panel 112. Approximately half is overlapped when at least 25% is overlapped but less than 75% is overlapped.

As further illustrated in FIG. 4, a product 300 may be received in the main compartment 204. Various embodiments of products may be received therein. However, in the illustrated embodiment the product 300 comprises a container 301, such as a blister pack, including a base 302 and a bubble 304 with a consumable item therein, such as a cartridge for an aerosol delivery device received. As illustrated, the base 302 has a larger surface area than a respective portion of the bubble 304 resulting in a flange portion 306 of the base 302 extending around the bubble 304. Although not visible in FIG. 4 and FIG. 5, the container 301 can include a backing layer on the side of the base opposing the bubble 304, the backing layer being configured for sealing the consumable item within the bubble and being configured for displacement of the consumable item therethrough.

In some embodiments, the product 300 is positioned within the package 200 with at least a portion of the flange 306 disposed between the bottom panel 108 and the edge region 126 of the overlapping panel 112, i.e. within the pocket 206. The degree of a friction fit between the pocket 206 and the flange 306 can be at least partially controlled based upon the rigidity of the material used for the blank 100, the length D1 of the edge region 126 and the length and thickness of the flange 306. In some embodiments, the container 301 is sized and positioned such that the distal end 125 of the overlapping panel 112 may abut a side of the bubble 304. A portion of the base 302 may be positioned to abut the first connecting panel 114A. This optional configuration further limits the container's ability to move side to side while within the package 200.

Separate portions of the base 302 may extend from the bubble 304 to an extent that these separate portions of the base 302 abut at least one of the end panels 116, 118 when the package is in an enclosed position. Such a configuration would limit sliding of the container 301 within the package 200 and help prevent inadvertent loss of the product 300. However, when the end panels 116, 118 are unfolded as seen in FIGS. 4 and 5, the container 301 may be able to be slide from package 200. The combination of securely holding the container within the package while being able to slide the container from the package provides advantages to the manufacture of the filled packages 200 while also providing access to the consumable for the user.

In other embodiments, the security of the product 300 within the package 200 can be increased by using an adhesive or the like between the package 200 and portions of the product 300. The package 200 need not be limited based upon the products to be contained therein and various other embodiments of products may be received in the main compartment in other embodiments. For example, the product may or may not include the flange portion 306 or equivalents for positioning under the edge region 126, and the product 300 may or may not include bubbles 304.

Figure 6:
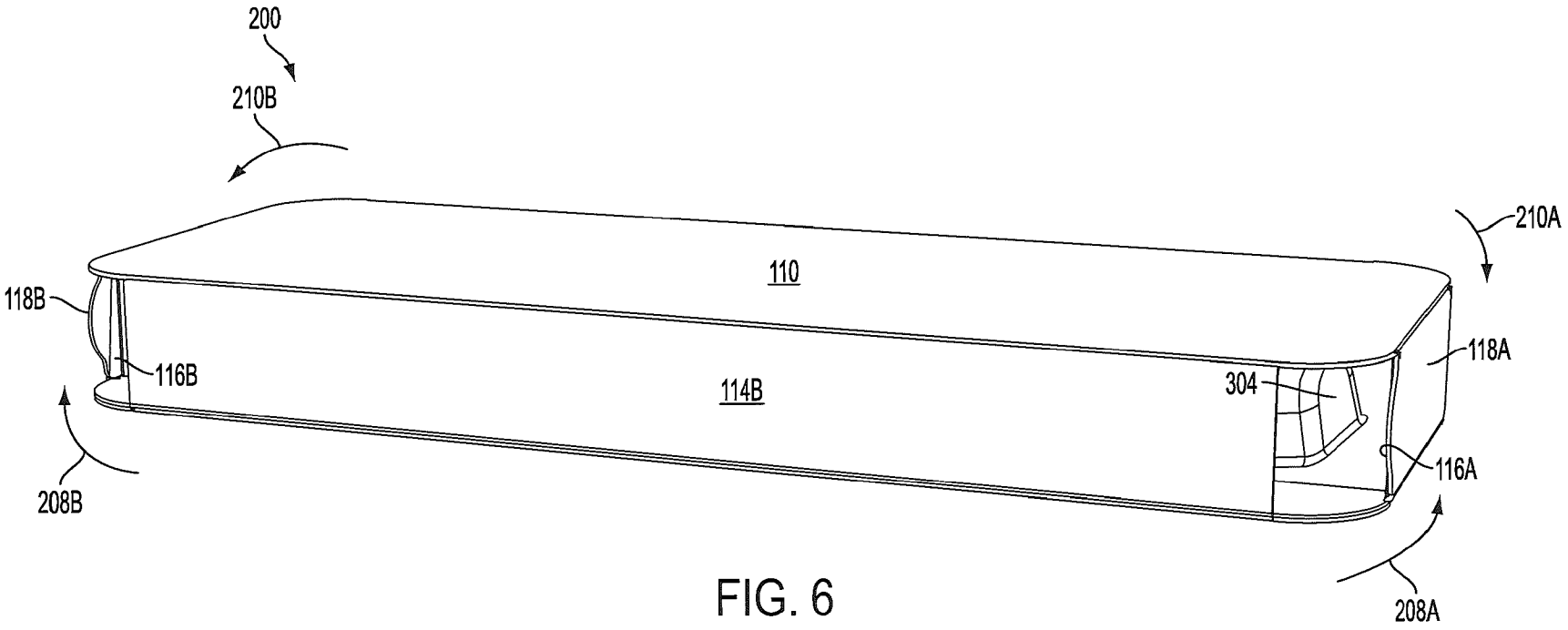
FIG. 6 is a perspective view of the package of FIG. 4 with the package in a closed configuration including end panels closed according to an example embodiment of the present disclosure.

As illustrated in FIG. 6, one of the final steps in formation of the package 200 may include folding the first end panels 116A, B relative to the bottom panel 108 at respective fifth and sixth fold lines 120E, F. More particularly, the first end panels 116 may be folded substantially upwardly, in terms of the orientation illustrated in FIG. 6, as indicated by arrows 208A, B. Further, the second end panels 118A, B may be folded downwardly at respective seventh and eighth fold lines 120G, H relative to the top panel 110, in terms of the orientation illustrated in FIG. 6, as indicated by arrows 210A, B.

The first end panels 116 may be coupled to the second end panels 118 during the folding movement illustrated in FIG. 6 via an adhesive as described above or other bonding mechanism such as via a heat weld. As illustrated in FIG. 1, an adhesive may be placed on the first side 102 of the blank 100 at adhesive areas 156A, B on the first end panels 116 when following the folding pattern shown in FIG. 6. Alternatively or additionally, an adhesive may be placed on the second side 104 of the blank 100 at adhesive areas 158A, B on the second end panels 118, as seen in FIG. 2 if folding as shown in FIG. 6. Accordingly, the first end panels 116 and the second end panels 118 may be coupled together with at least one layer of adhesive placed in-between in order to retain one or more products within the main compartment 204 of the package 200.

While the steps illustrated in FIG. 6 result in the first end panels 116 positioned relatively inside toward the compartment 204 and the second end panels 118 positioned relatively outside, in some other embodiments, the order of folding may be reversed, with the second end panels 118 folded relatively downward followed by the first end panels 116 folded relatively upward. Thus in these other embodiments, the first end panels 116 would be positioned outwardly and the second end panels 118 would be positioned inwardly.

Where an adhesive is used to couple the outwardly positioned first end panels 116 with the inwardly second end panels 118, it should be understood that the location of adhesive areas 156, 158 should change from their locations shown in FIGS. 1 and 2, such that the adhesive areas are disposed between the respective first and second end panel when the package 200 is in a substantially enclosed configuration. Thus, in an alternate embodiment, adhesive areas 156A, B may be present on the second side 104 of the end panels 116A, B and absent on the first side 102 of the end panels 116A, B. In such alternate embodiment, adhesive areas 158A, B may be present on the first side 102 of the end panels 118A, B and absent on the second side 104 of the end panels 118A, B. In further embodiments, adhesive areas may be present only on the appropriate side of end panels 116A,B or only on the appropriate side of end panels 118A, B so that the respective glue areas are positioned between end panels 116A and 118A and between end panels 116B and 118B when in the folded state.

Further still, it should be appreciated that both of the first end panels 116A,B do not have to be folded in succession, but one of the first end panels (e.g. 116A) could be folded followed by one of the second end panels (e.g. 116B).

As should be understood from the preceding series of steps and the accompanying figures, each panel 108, 110, 112, 114, 116, 118 forming the blank 100 as described herein may constitute a portion of the blank 100 that remains substantially planar, is not folded with respect to itself, when the package 200 is completed. Put another way, in some embodiments, the panels define portions of the blank that, while folded relative to one another to form the package 200, are not themselves substantially folded, creased, bent, etc.

In one example embodiment, the package 200 may define a height of about 5 to about 15 mm (e.g., about 10 mm), a width of about 100 to about 120 mm (e.g., about 110 mm) and a depth of about 30 to about 50 mm (e.g., about 40 mm). However, various other sizes of the package may be employed depending on the product stored therein. By way of example, when a product stored therein includes a greater number of products, the package may define larger dimensions, whereas in an embodiment in which the product includes a fewer number of products, the package may define smaller dimensions.

Although directional terms such as top, bottom, front, back, etc. have been employed herein, it should be understood that these terms have been provided for explanatory purposes only. In this regard, the blank and package disclosed herein may be employed in other configurations and orientations beyond those described above.

Many modifications and other embodiments of the disclosure will come to mind to one skilled in the art to which this disclosure pertains having the benefit of the teachings presented in the foregoing description; and it will be apparent to those skilled in the art that variations and modifications of the present disclosure can be made without departing from the scope or spirit of the disclosure. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A blank configured to form a package, the blank comprising:

a bottom panel;

a top panel coupled to the bottom panel; and an overlapping panel coupled to the top panel, the overlapping panel comprising:

an edge region that is configured to remain unattached to the bottom panel when forming the package; and an adjoining region, the adjoining region positioned between the edge region and the top panel, wherein the overlapping panel is configured to overlap with the bottom panel such that both of the adjoining region and the edge region are overlaying the bottom panel and attach to the bottom panel at the adjoining region when forming the package.

2. The blank of claim 1, further comprising a first connecting panel positioned between the bottom panel and the top panel, and a second connecting panel positioned between the top panel and the overlapping panel.

3. The blank of claim 1, further comprising:

a first plurality of end panels coupled to the bottom panel; and a second plurality of end panels coupled to the top panel, wherein the first plurality of end panels are configured to overlap with the second plurality of end panels when forming the package.

4. The blank of claim 3, wherein the second plurality of end panels are longer in a longitudinal direction than the first plurality of end panels.

5. A package, comprising:

a bottom panel;

a top panel coupled to the bottom panel;

an overlapping panel coupled to the top panel;

a first connecting panel positioned between the bottom panel and the top panel; and a second connecting panel positioned between the top panel and the overlapping panel, wherein the overlapping panel further comprising:

an edge region; and an adjoining region, the adjoining region positioned between the edge region and the top panel, wherein the overlapping panel is overlapping at least a portion of the bottom panel to form a compartment such that both of the adjoining region and the edge region are overlaying the bottom panel, the adjoining region is attached to the bottom panel, and the edge region is unattached to the bottom panel.

6. The package of claim 5, wherein the compartment provides a substantially uniform rectangular cross section along a lateral direction.

7. The package of claim 5, wherein the bottom panel is not completely overlapped by the overlapping panel.

8. The package of claim 7, wherein approximately half of the bottom panel is overlapped by the overlapping panel.

9. The package of claim 5, further comprising:

a first plurality of end panels coupled to the bottom panel; and a second plurality of end panels coupled to the top panel, wherein the first plurality of end panels overlap with the second plurality of end panels.

10. The package of claim 9, wherein the second plurality of end panels are longer in a longitudinal direction than the first plurality of end panels.

11. The package of claim 5, wherein the edge region and the adjoining region approximately bisect the overlapping panel.

12. The package of claim 5, further comprising a container positioned within the cavity.

13. The package of claim 12, wherein the container comprises a flange disposed between the bottom panel and the edge region of the overlapping panel.

14. A method for forming a package, the method comprising:

providing a blank defining a first side and a second side, the blank comprising:

a bottom panel;

a top panel coupled to the bottom panel; and an overlapping panel coupled to the top panel, the overlapping panel comprising:

an edge region; and an adjoining region, the adjoining region positioned between the edge region and the top panel;

folding the blank between the overlapping panel and the top panel toward the second side;

folding the blank between the top panel and the bottom panel toward the second side; and attaching the adjoining region of the overlapping panel to the bottom panel such that both of the adjoining region and the edge region are overlaying the bottom panel and the edge region remains substantially unattached to the bottom panel.

15. The method of claim 14, wherein folding the blank avoids folding each of the top panel, the bottom panel and the overlapping panel with respect to itself.

16. The method of claim 14, wherein the blank further comprises a first plurality of end panels coupled to the bottom panel and a second plurality of end panels coupled to the top panel, the method further comprising folding the first plurality of end panels relative to the bottom panel toward the second side, folding the second plurality of end panels relative to the top panel toward the second side, and coupling the first plurality of end panels to the second plurality of end panels.

* * * * *